US010907444B1

(12) United States Patent
Brown

(10) Patent No.: US 10,907,444 B1
(45) Date of Patent: Feb. 2, 2021

(54) CHOKE SYSTEM FOR A DOWNHOLE VALVE

(71) Applicant: Donavan Holland Brown, Houston, TX (US)

(72) Inventor: Donavan Holland Brown, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/505,802

(22) Filed: Jul. 9, 2019

(51) Int. Cl.
*E21B 34/10* (2006.01)

(52) U.S. Cl.
CPC ..... *E21B 34/10* (2013.01); *E21B 2200/06* (2020.05)

(58) Field of Classification Search
CPC ..... E21B 34/10; E21B 2200/06
See application file for complete search history.

(56) References Cited

U.S. PATENT DOCUMENTS

| | | | | |
|---|---|---|---|---|
| 5,957,208 | A * | 9/1999 | Schnatzmeyer | E21B 34/06 166/373 |
| 6,371,208 | B1 * | 4/2002 | Norman | E21B 34/06 166/334.4 |
| 6,378,612 | B1 * | 4/2002 | Churchill | E21B 21/103 166/319 |
| 9,328,579 | B2 * | 5/2016 | Wilson | E21B 21/103 |
| 9,500,063 | B2 * | 11/2016 | Greenan | E21B 34/14 |
| 10,030,478 | B2 | 7/2018 | Johnson et al. | |
| 10,156,124 | B2 * | 12/2018 | Guzman | E21B 34/10 |
| 10,184,318 | B2 * | 1/2019 | Nichols | E21B 34/10 |
| 2002/0157837 | A1 * | 10/2002 | Bode | E21B 43/12 166/373 |
| 2004/0007356 | A1 | 1/2004 | Myron | |
| 2009/0065214 | A1 | 3/2009 | Purkis | |
| 2015/0041133 | A1 * | 2/2015 | Chauffe | E21B 43/14 166/284 |
| 2017/0370168 | A1 * | 12/2017 | Farrar | E21B 34/14 |

FOREIGN PATENT DOCUMENTS

EP 0893575 A2 1/1999

OTHER PUBLICATIONS

International Search Report and Written Opinion for International Application No. PCT/US2020/040095; International Filing Date Jun. 29, 2020; dated Oct. 30, 2020 (pp. 1-10).

* cited by examiner

*Primary Examiner* — Matthew R Buck
(74) *Attorney, Agent, or Firm* — Cantor Colburn LLP

(57) ABSTRACT

A choke system for a downhole valve including a first tubular having an outer surface, an inner surface, and a first flow port extending through the outer surface and the inner surface. A second tubular is shiftably arranged relative to the first tubular radially inwardly of the inner surface. The second tubular includes a second flow port that is selectively aligned with the first flow port. A choke member including a choke opening is positioned between the first tubular and the second tubular. The choke member is selectively shiftable and rotatable relative to the first tubular and the second tubular. A choke actuator is axially aligned with the choke member and positioned between the first tubular and the second tubular. The choke actuator being selectively shiftable to unseat the choke member and rotate the choke opening relative to the first and second flow ports.

12 Claims, 6 Drawing Sheets

CHOKE SYSTEM FOR A DOWNHOLE VALVE

BACKGROUND

In the resource recovery industry valves are employed to control flow from, for example, an annulus, into a flow path of a tubular. The valve may allow formation fluids to flow to a surface system for collection, testing, and/or processing. In some installations, a choke or flow restrictor may be employed in connection with the valve. The choke extends about and is fixed relative to the valve. The choke includes a selected opening geometry that exposes different portions of the valve depending on valve position.

The valve may be opened or closed by applying pressure to one or more actuators, Each time the valve is shifted from an open to closed position, a rotation occurs relative to the choke. Thus, setting the desired choke requires multiple open and close operations of the valve. Each open and close operation of the valve places stress on valve seals, requires a long actuation stroke, e.g., entire valve opening must shift relative to a valve inlet and the choke. Further, any adjustment of the choke requires the valve to cycle between open and closed positions. Accordingly, the industry would welcome a choke system that allows for setting a choke position independent of the valve.

SUMMARY

Disclosed is a choke system for a downhole valve including a first tubular having an outer surface, an inner surface, and a first flow port extending through the outer surface and the inner surface. A second tubular is shiftably arranged relative to the first tubular radially inwardly of the inner surface. The second tubular includes a second flow port that is selectively aligned with the first flow port. A choke member including a choke opening is positioned between the first tubular and the second tubular. The choke member is selectively shiftable and rotatable relative to the first tubular and the second tubular. A choke actuator is axially aligned with the choke member and positioned between the first tubular and the second tubular. The choke actuator being selectively shiftable to unseat the choke member and rotate the choke opening relative to the first and second flow ports.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
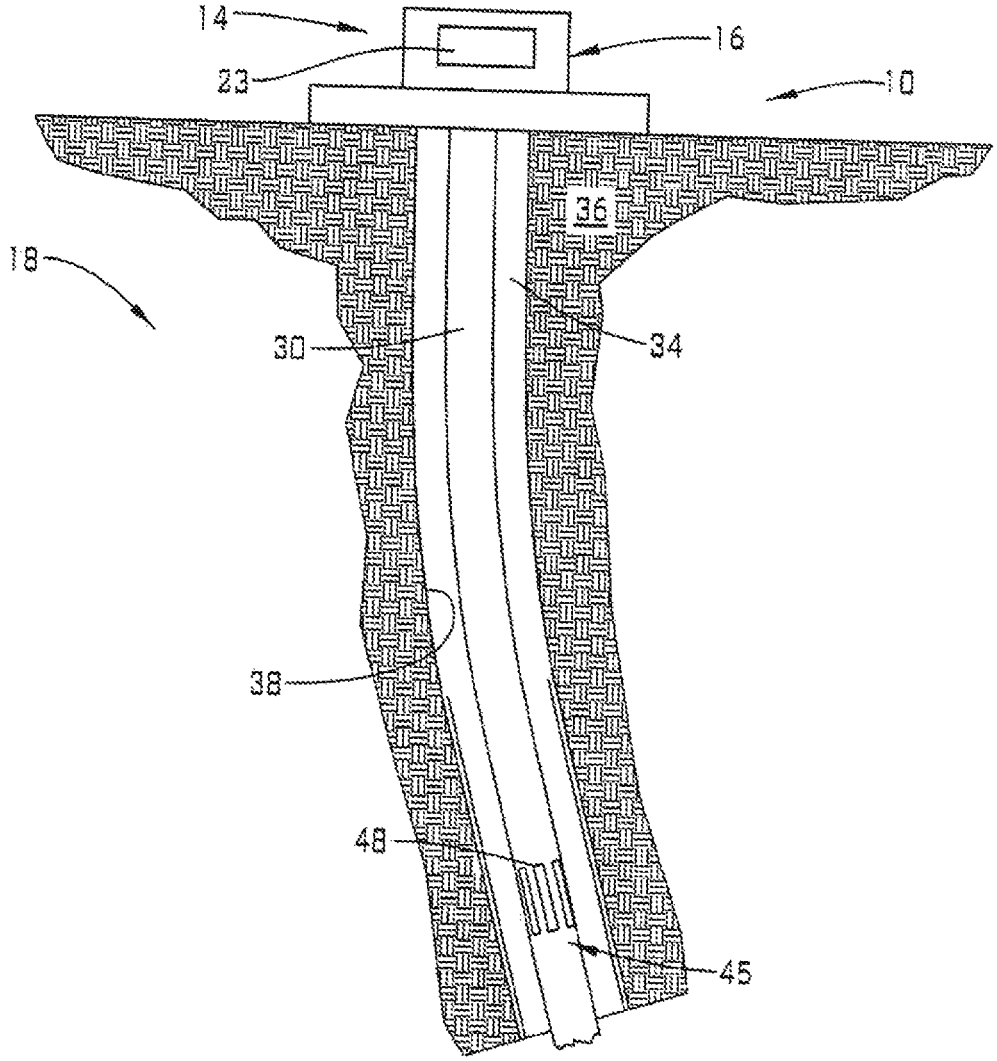
FIG. 1 depicts a resource exploration and recovery system including a valve having a choke system, in accordance with an exemplary embodiment.
Figure 2:
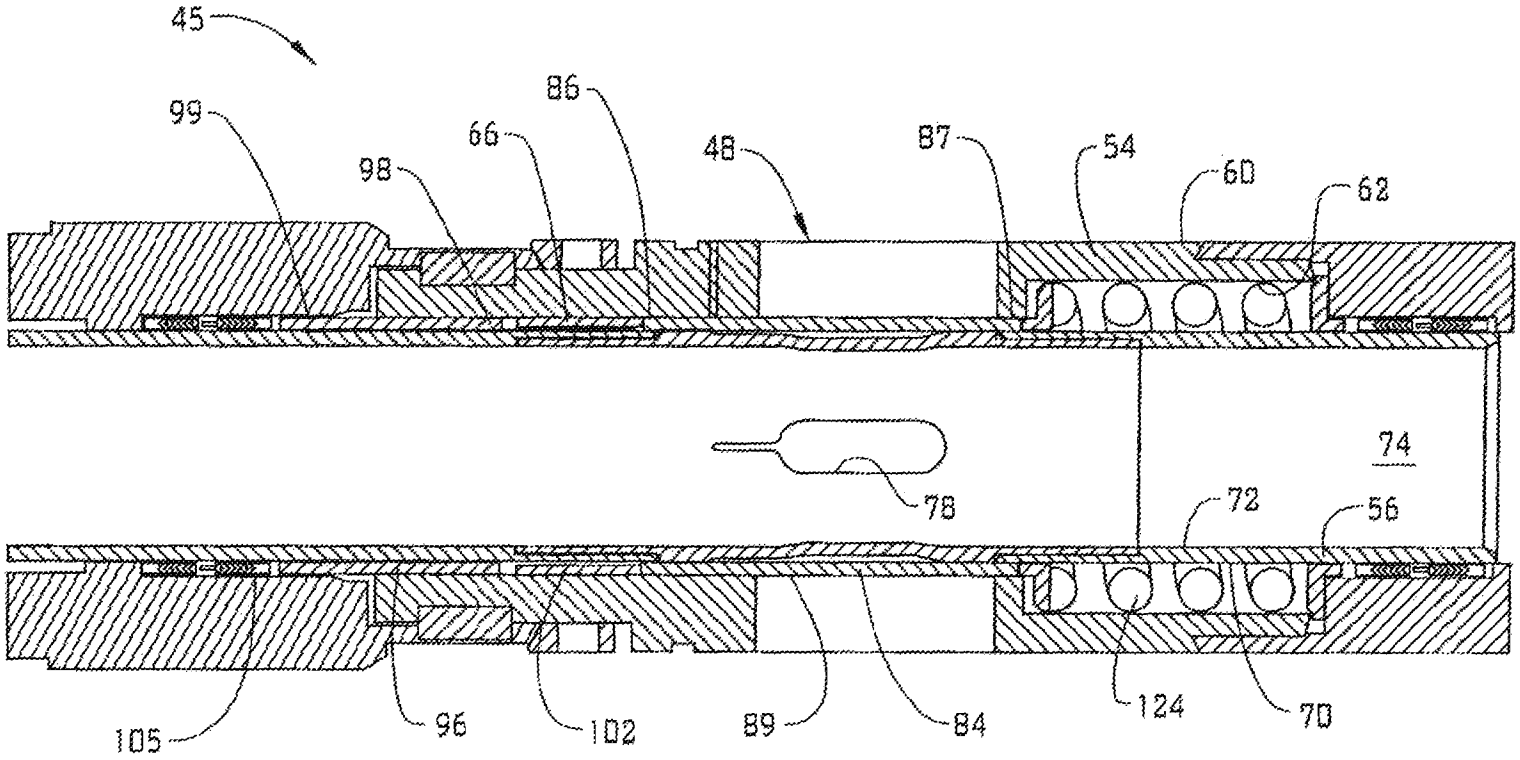
FIG. 2 depicts a cross-sectional view of the valve and choke system of FIG. 1, in accordance with an aspect of an exemplary embodiment

A resource exploration and recovery system, in accordance with an exemplary embodiment, is indicated generally at 10, in FIGS. 1 and 2. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in formation 36. Tubular string 30 may take the form of a plurality of interconnected tubulars, coil tubing, or the like. Wellbore 34 includes an annular wall 38 which may be defined by a surface of formation 36. Further, it should be understood, that wellbore 34 may include a casing tubular (not shown). Tubular string 30 may support a valve 45 including one or more first flow ports 48.

Figure 3A:
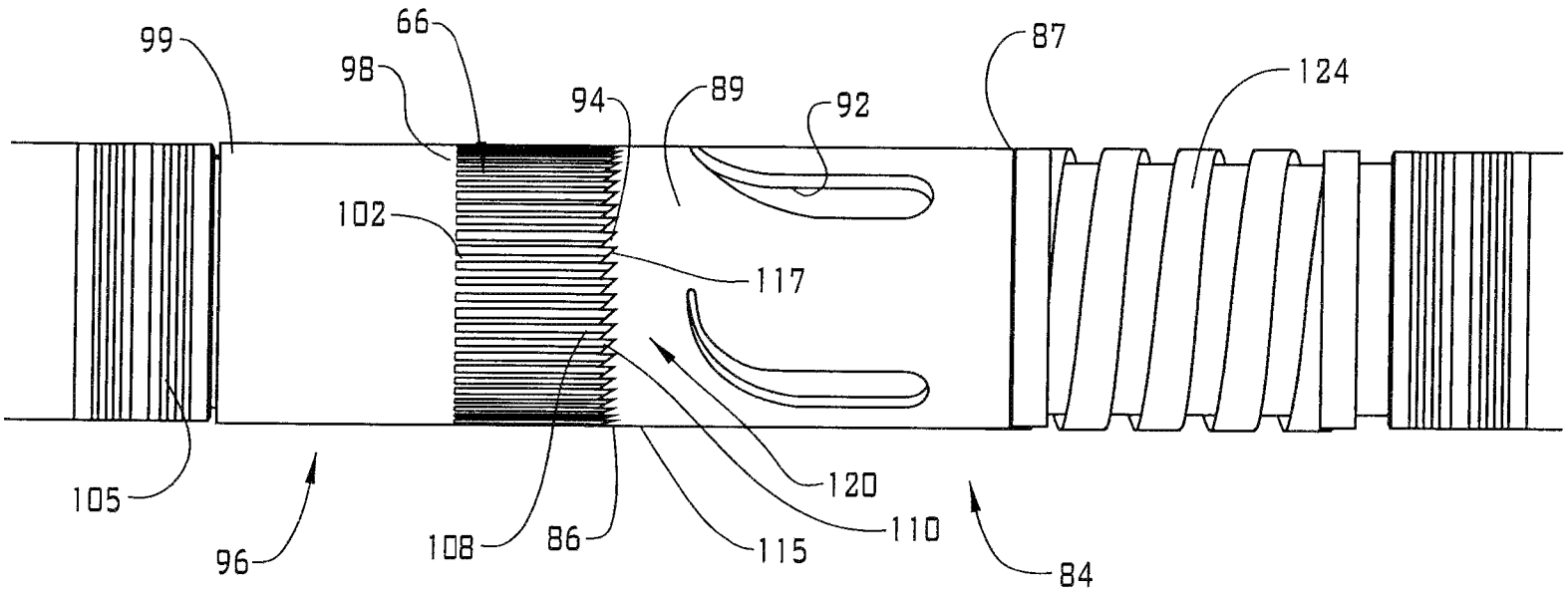
FIG. 3A depicts a choke member and choke actuator of the valve and choke system of FIG. 2, in accordance with an aspect of an exemplary embodiment.

Referring to FIGS. 2 and 3A, valve 45 includes a first tubular 54 and a second tubular 56 arranged within first tubular 54. First tubular 54 includes an outer surface 60 and an inner surface 62. A plurality of choke support elements 66 projects radially inwardly from inner surface 62. Second tubular 56 includes an outer surface portion 70 and an inner surface portion 72 that defines a flow path 74. A plurality of second flow ports, one of which is indicated at 78, is formed in second tubular 56. Second tubular 56 is axially shiftable within first tubular 54 such that second flow ports 78 may selectively align with first flow ports 48.

In an embodiment, valve 45 includes a choke member 84 that is selectively positioned to establish a selected size of second flow ports 78. In an embodiment, choke member 84 includes a first axial end 86, a second axial end 87, and an intermediate portion 89 extending therebetween. Intermediate portion 89 includes a plurality of choke openings, one of which is indicated at 92, having a shape that is configured to selectively establish a size of second flow ports 78. First axial end 86 includes a plurality of tooth elements 94 that cooperate with a choke actuator 96 to rotate choke member 84. That is, as will be discussed herein, choke member 84 is selectively rotated so that choke opening 92 exposes more or less of second flow ports 78 to achieve a desired flow rate between flow ports 48 and flow path 74.

Figure 3B:
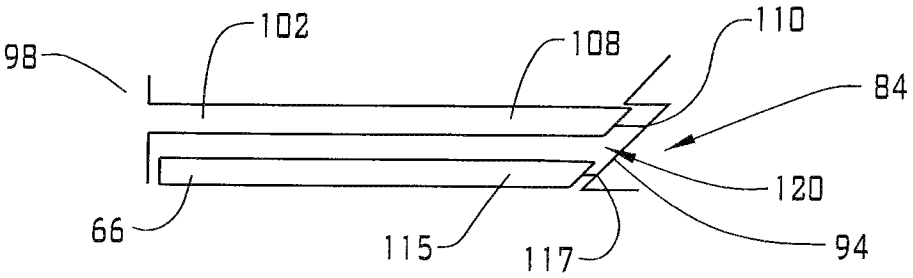
FIG. 3B depicts an interface between the choke member and choke actuator of FIG. 3A, in accordance with an aspect of an exemplary embodiment.

In an embodiment, choke actuator 96 includes a first end 98 and a second end 99. A plurality of actuator elements 102 project axially outwardly of first end 98. An annular seal 105 may be arranged axially outwardly of second end 99. As shown in FIG. 3B, each of the plurality of actuator elements 102 extends between adjacent ones of the plurality of choke support elements 66 and includes a terminal end portion 108 having an angled surface portion 110. Each of the plurality of choke support elements 66 includes a terminal end section 115 having an angled surface section 117. Each angled surface portion 110 and angled surface section 117 align to form a choke support surface 120. Further, each angled surface portion 110 and angled surface section 117 includes an angle that is complimentary of an angle defined by tooth elements 94.

In an embodiment, pressure may be applied to choke actuator 96 via annular seal 105. The pressure causes choke actuator 96 to shift axially such that actuation elements 102 act upon tooth elements 94 unseating choke member 84 from choke support elements 66. Actuation elements 102 force choke member 84 against spring 124. An interaction between angled surface portions 110 and tooth elements 94 causes choke member 84 to rotate and change a degree of opening of second flow port 78. Pressure may be relieved allowing spring 124 to urge choke member 84 back onto choke support elements 66. Each application of pressure unseats and rotates choke member 84 by one tooth element 94 so as to further change the degree of opening of second flow port 78.

Figure 4:
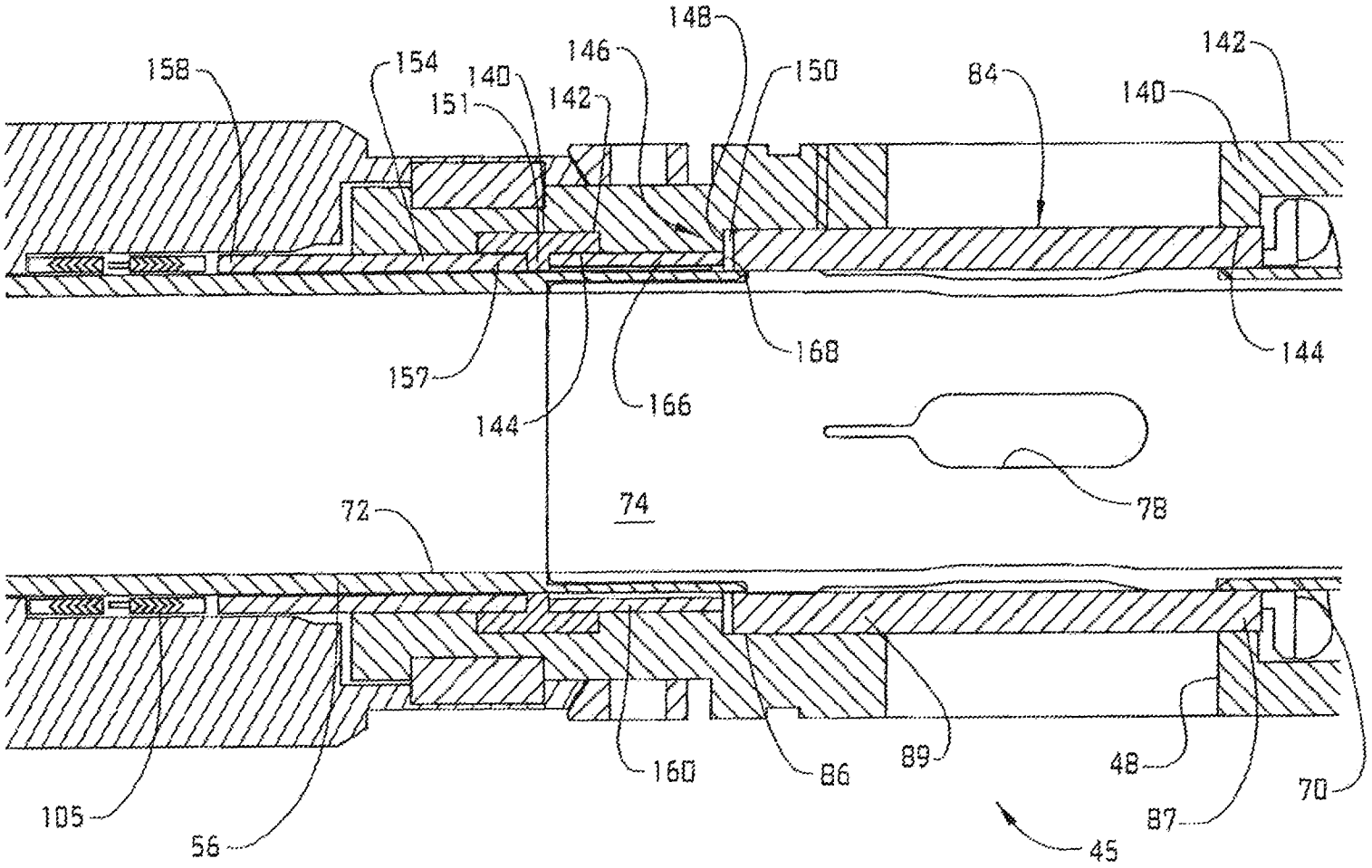
FIG. 4 depicts a cross-sectional view of a valve and choke system, in accordance with another aspect of an exemplary embodiment.
Figure 5:
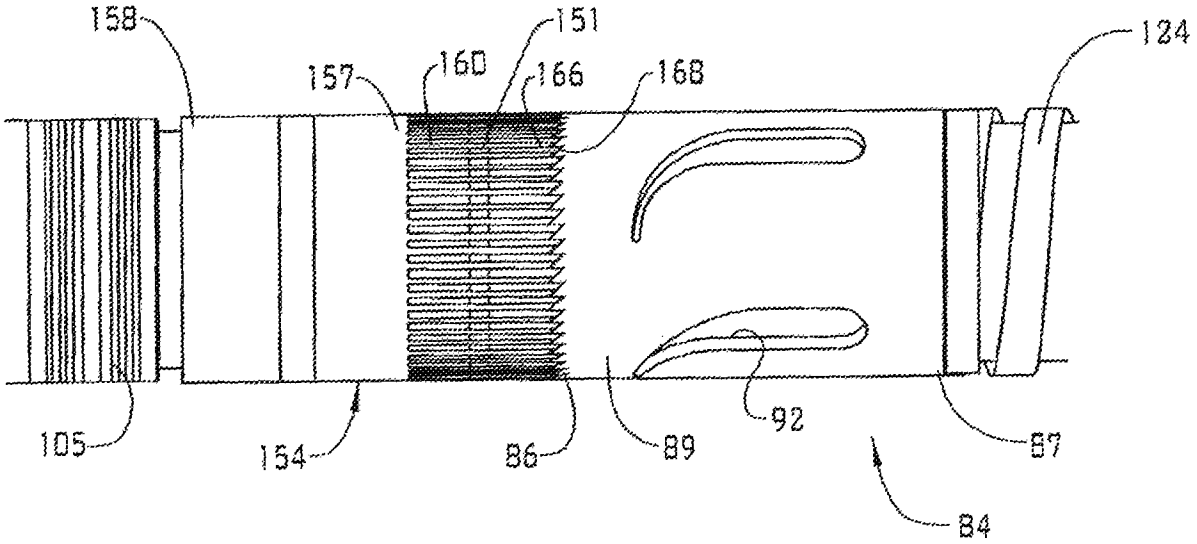
FIG. 5 depicts a choke member and choke actuator of the valve and choke system of FIG. 4, in accordance with another aspect of an exemplary embodiment.

Referring to FIGS. 4 and 5 wherein like reference numbers represent corresponding parts in the respective views, in describing first tubular 140 in accordance with another aspect of an exemplary embodiment. First tubular 140 includes an outer surface 142 and an inner surface 144. A choke support 146 is formed in inner surface 144. Choke support 146 includes a plurality of choke support elements, one of which is indicated at 148 each having an angled surface section 150. In addition, a plurality of guide elements, one of which is shown at 151 project radially inwardly of inner surface 144.

A choke actuator 154 is arranged radially inwardly of inner surface 144 and substantially axially aligned with choke member 84. Choke actuator 154 includes a first end 157 and a second end 158. Annular seal 105 is arranged axially outwardly of second end 158. A plurality of actuator elements 160 extend axially outwardly of first end 157. Each of the plurality of actuator elements 160 includes a terminal end portion 166 having an angled surface portion 168. Angled surface portion 168 may include one or more angled surfaces. In an embodiment, each of the plurality of guide elements 151 are arranged between corresponding ones of the plurality of actuator elements 160. Guide elements 151 prevent rotation of choke actuator 154.

In an embodiment, pressure may be applied to choke actuator 154 via annular seal 105. The pressure causes choke actuator 154 to shift axially such that actuation elements act upon tooth elements 94 unseating choke member 84 from choke support elements 148. Actuation elements 160 force choke member 84 against spring 124. An interaction between angled surface portions 168 and tooth elements 94 causes choke member 84 to rotate and change a degree of opening of second flow port 78. Pressure may be relieved allowing spring 124 to urge choke member 154 back onto choke support elements 148 of choke support 146. Each application of pressure unseats and rotates choke member 84 by one tooth element 94 so as to further change the degree of opening of second flow ports 78.

Figure 6:
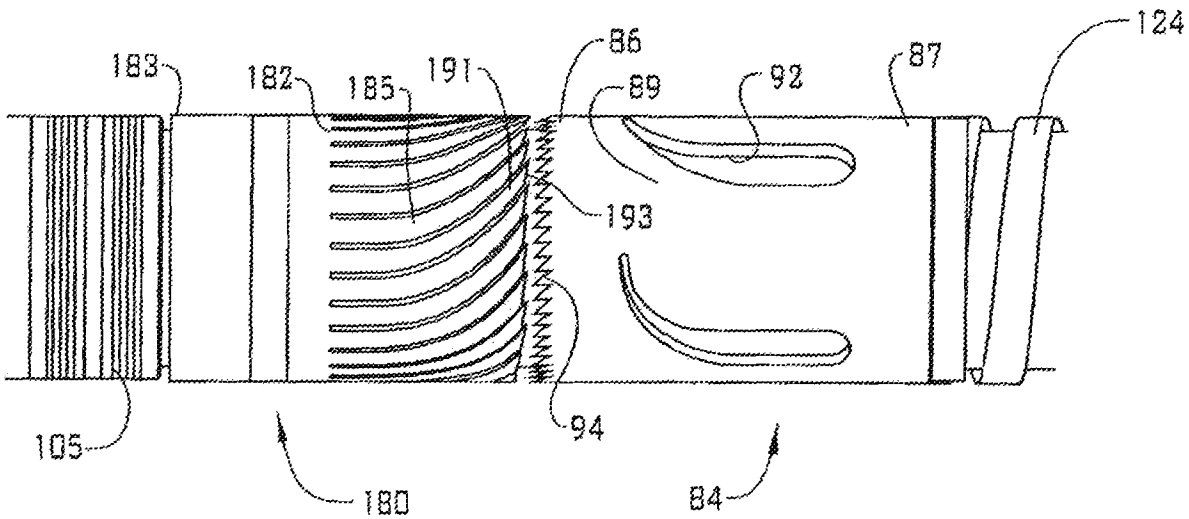
FIG. 6 depicts a choke member and choke actuator of the valve and choke system of FIG. 4, in accordance with yet another aspect of an exemplary embodiment.

Reference will now follow to FIG. 6, wherein like reference numbers represent corresponding parts in the respective views, in describing a choke actuator 180 in accordance with yet another aspect of an exemplary embodiment. Choke actuator 180 includes a first end 182 and a second end 183. Annular seal 105 is arranged axially outwardly of second end 183. A plurality of actuator elements 185 extend axially outwardly of first end 182. Each of the plurality of actuator elements 185 includes a terminal end portion 191 having an angled surface portion 193. In an embodiment, each of the plurality of actuator elements 185 is flexible. That is, each of the plurality of actuator elements 185 may deflect circumferentially when urged into contact with choke member 84 to adjust a degree of opening of second flow ports 78.

At this point, it should be understood that the exemplary embodiments describe a valve including an independent choke. That is, the choke is decoupled from the opening and closing of the valve. In this manner, an overall axial length of the valve may be reduced. Further, the valve may be operated regardless of a position of the choke. That is, instead of opening and closing a valve to set the choke, a number of pressure applications may be applied to the choke system to set the selected degree of opening. Once the selected degree of opening is established the valve may be opened. In this manner, flow may pass uninterrupted between formation 36 and flow path 74.

Embodiment 1. A choke system for a downhole valve comprising: a first tubular including an outer surface, an inner surface, and a first flow port extending through the outer surface and the inner surface; a second tubular shiftably arranged relative to the first tubular radially inwardly of the inner surface, the second tubular including a second flow port that is selectively aligned with the first flow port; a choke member including a choke opening positioned between the first tubular and the second tubular, the choke member being selectively shiftable and rotatable relative to the first tubular and the second tubular; and a choke actuator axially aligned with the choke member and positioned between the first tubular and the second tubular, the choke actuator being selectively shiftable to unseat the choke member and rotate the choke opening relative to the first and second flow ports.

Embodiment 2. The choke system according to any prior embodiment, further comprising: a return spring positioned to bias the choke member toward the choke actuator.

Embodiment 3. The choke system according to any prior embodiment, wherein the return spring extends about the second tubular.

Embodiment 4. The choke system according to any prior embodiment, wherein the choke actuator includes a first end, a second end, and a plurality of actuator elements extending axially outwardly of the first end.

Embodiment 5. The choke system according to any prior embodiment, further comprising: a plurality of choke support elements provided at the inner surface of the first tubular.

Embodiment 6. The choke system according to any prior embodiment, wherein each of the plurality of actuator elements extend between adjacent ones of the plurality of choke support elements.

Embodiment 7. The choke system according to any prior embodiment, wherein each of the plurality of actuator elements includes a terminal end portion including an angled surface portion and each of the plurality of choke support elements includes a terminal end section including an angled surface section.

Embodiment 8. The choke system according to any prior embodiment, wherein the angled surface portion of each of the plurality of actuator elements selectively aligns with corresponding ones of the angled surface section of each of the plurality of choke support elements to form a choke support surface.

Embodiment 9. The choke system according to any prior embodiment, wherein the choke member includes a first axial end and an opposing second axial end, the opposing second axial end including a plurality of tooth elements that selectively engage with the choke support surface.

Embodiment 10. The choke system according to any prior embodiment, wherein the plurality of actuator elements are arranged radially inwardly of the plurality of choke support elements.

Embodiment 11. The choke system according to any prior embodiment, further comprising: a plurality of guide elements extending radially inwardly of the first tubular, each of the plurality of guide elements extending between adjacent ones of the plurality of actuation elements.

Embodiment 12. The choke system according to any prior embodiment, wherein each of the plurality of actuator elements includes a terminal end portion including an angled surface portion having one or more angled surfaces.

Embodiment 13. The choke system according to any prior embodiment, wherein each of the plurality of actuator elements is circumferentially deformable.

Embodiment 14. The choke system according to any prior embodiment, wherein each of the plurality of actuator elements includes a terminal end portion including an angled end portion.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A choke system for a downhole valve comprising:

a first tubular including an outer surface, an inner surface, and a first flow port extending through the outer surface and the inner surface;

a second tubular shiftably arranged relative to the first tubular radially inwardly of the inner surface, the second tubular including a second flow port that is selectively aligned with the first flow port;

a choke member including a choke opening positioned between the first tubular and the second tubular, the choke member being selectively shiftable and rotatable relative to the first tubular and the second tubular;

a choke actuator axially aligned with the choke member and positioned between the first tubular and the second tubular, the choke actuator being selectively shiftable to unseat the choke member and rotate the choke opening relative to the first and second flow ports; and a return spring positioned to bias the choke member toward the choke actuator.

2. The choke system according to claim 1, wherein the return spring extends about the second tubular.

3. A choke system for a downhole valve comprising:

a first tubular including an outer surface, an inner surface, and a first flow port extending through the outer surface and the inner surface;

a second tubular shiftably arranged relative to the first tubular radially inwardly of the inner surface, the second tubular including a second flow port that is selectively aligned with the first flow port;

a choke member including a choke opening positioned between the first tubular and the second tubular, the choke member being selectively shiftable and rotatable relative to the first tubular and the second tubular;

a plurality of choke support elements provided at the inner surface of the first tubular; and a choke actuator axially aligned with the choke member and positioned between the first tubular and the second tubular, the choke actuator being selectively shiftable to unseat the choke member and rotate the choke opening relative to the first and second flow ports, wherein the choke actuator includes a first end, a second end, and a plurality of actuator elements extending axially outwardly of the first end.

4. The choke system according to claim 3, wherein each of the plurality of actuator elements extend between adjacent ones of the plurality of choke support elements.

5. The choke system according to claim 4, wherein each of the plurality of actuator elements includes a terminal end portion including an angled surface portion and each of the plurality of choke support elements includes a terminal end section including an angled surface section.

6. The choke system according to claim 5, wherein the angled surface portion of each of the plurality of actuator elements selectively aligns with corresponding ones of the angled surface section of each of the plurality of choke support elements to form a choke support surface.

7. The choke system according to claim 6, wherein the choke member includes a first axial end and an opposing second axial end, the opposing second axial end including a plurality of tooth elements that selectively engage with the choke support surface.

8. The choke system according to claim 3, wherein the plurality of actuator elements are arranged radially inwardly of the plurality of choke support elements.

9. The choke system according to claim 8, further comprising: a plurality of guide elements extending radially inwardly of the first tubular, each of the plurality of guide elements extending between adjacent ones of the plurality of actuator elements.

10. The choke system according to claim 8, wherein each of the plurality of actuator elements includes a terminal end portion including an angled surface portion having one or more angled surfaces.

11. The choke system according to claim 8, wherein each of the plurality of actuator elements is circumferentially deformable.

12. The choke system according to claim 11, wherein each of the plurality of actuator elements includes a terminal end portion including an angled end portion.

* * * * *